US005539142A

United States Patent [19]

Emerson et al.

[11] Patent Number: 5,539,142

[45] Date of Patent: Jul. 23, 1996

[54] COMBINED ACOUSTIC AND ELECTRONIC PIANO IN WHICH THE ACOUSTIC ACTION IS DISABLED WHEN PLAYED IN THE ELECTRONIC MODE

[75] Inventors: George F. Emerson, Jonesboro, Ark.; Thomas E. Kimble, Cincinnati, Ohio

[73] Assignee: Baldwin Piano and Organ Company, Loveland, Ohio

[21] Appl. No.: 474,743

[22] Filed: Jun. 7, 1995

[51] Int. Cl.[6] ..... G10D 15/00

[52] U.S. Cl. ..... 84/171; 84/22

[58] Field of Search ..... 84/171, 219, 220, 84/240, 423 R

[56] References Cited

U.S. PATENT DOCUMENTS

| | | | |
|---|---|---|---|
| 2,250,065 | 7/1941 | Koehl | 84/171 |
| 4,633,753 | 1/1987 | Takahashi | 84/220 |
| 4,679,477 | 7/1987 | Monte | 84/423 R |
| 4,682,526 | 7/1987 | Hall et al. | 84/DIG. 22 |
| 4,704,931 | 11/1987 | Nagai et al. | 84/171 |
| 4,719,834 | 1/1987 | Hall et al. | 84/DIG. 22 |
| 4,744,281 | 5/1988 | Isozaki | 84/DIG. 12 |
| 4,970,928 | 11/1990 | Tamaki | 84/21 |
| 4,970,929 | 11/1990 | Ishida | 84/220 |
| 5,003,859 | 4/1991 | Monte et al. | 84/423 R |
| 5,115,705 | 5/1992 | Monte et al. | 84/617 |
| 5,192,824 | 3/1993 | Shibukawa | 84/615 |
| 5,196,638 | 3/1993 | Hayashida et al. | 84/240 |
| 5,247,129 | 9/1993 | Nozaki et al. | 84/615 |
| 5,322,967 | 6/1994 | Matsuda | 84/653 |
| 5,374,775 | 12/1994 | Kawamura et al. | 84/615 |
| 5,386,083 | 1/1995 | Kawamura | 84/719 |

FOREIGN PATENT DOCUMENTS

| | | |
|---|---|---|
| 0573963A2 | 12/1993 | European Pat. Off. . |
| 3707591C1 | 5/1988 | Germany . |

*Primary Examiner*—Patrick J. Stanzione
*Attorney, Agent, or Firm*—Frost & Jacobs

[57] ABSTRACT

An improved combination acoustic-mode and electronic-mode piano is provided which includes a hammer shank stop rail that intercepts the hammer shank, when in the electronic mode, so that the hammer cannot complete its normal travel and cannot strike its corresponding string(s) when its piano key is actuated. The hammer shank stop rail is actuated by an intermediate crank that, in turn, is actuated by a pedal dowel attached to one of the pedals of the piano. When operated in the acoustic mode, the stop rail occupies a position that will not interfere with the hammer shank's movements, and when in the electronic mode, the stop rail intercepts the hammer shank so that its associated hammer will not be able to travel all the way into contact with their associated string. A second embodiment operates the stop rail by use of a cable and cam mechanism. A third embodiment uses a hand-actuator to operate the stop rail via a dowel and intermediate crank. In a fourth embodiment, a fluid-actuated hammer shank stop rail is located in a position similar to the mechanical hammer shank stop rail described hereinabove. The fluid-actuated hammer shank stop rail includes a rigid portion that provides support across the width of the piano and an expandable portion that is resilient and can be enlarged by the use of an internal fluid pressure, which intercepts the hammer shank before the associated hammer can strike their associated string. A fifth embodiment of a combination dual-mode piano is provided that utilizes a spring-loaded wippen-disabler to prevent the wippen from being actuated by the key tail when the associated key is struck. When placed into the electronic mode, the wippen-disabler is rotated into a position in which one of its extended members is forced against the bottom portion of the wippen and raises the wippen high enough into a position so that the capstan screw of the key tail cannot come into contact with the bottom surface of the wippen. In addition, a different portion of the wippen-disabler is rotated so that its associated spring comes into contact with the top of the key tail, thereby providing the person playing the piano with some mechanical feedback that will approximate the feel of a standard key action.

44 Claims, 10 Drawing Sheets

COMBINED ACOUSTIC AND ELECTRONIC PIANO IN WHICH THE ACOUSTIC ACTION IS DISABLED WHEN PLAYED IN THE ELECTRONIC MODE

TECHNICAL FIELD

The present invention relates generally to musical instruments and is particularly directed to pianos of the type which operate in both an acoustic mode and an electronic mode. The invention is specifically disclosed as an upright piano containing a standard acoustic piano key action along with an additional hammer shank stop rail that inhibits the striking of the strings by the hammer when the piano is played in its electronic mode.

BACKGROUND OF THE INVENTION

Acoustic pianos are very old in the art, and in the case of upright pianos, the acoustic piano has developed into a musical instrument that uses a rather standard key action. Generally speaking, a standard key action uses a key tail (the interior end of the key) to actuate a wippen, which then actuates a hammer shank through a jack and a hammer butt. The far end of the hammer shank is affixed to a hammer that strikes the individual string(s) corresponding to the given musical tone for that key. The standard piano action also uses dampers to silence the string(s), until the damper is de-actuated by pressing its corresponding key or by pressing one of two pedals which simultaneously de-actuates all or one section of the dampers.

Electronic pianos are also old in the art, and it is standard in conventional electronic pianos to detect the movement of each of the individual keys by some type of sensor that generates an electrical signal. Some of these sensors are optical in nature, others detect pressure or force induced against the key by a human user. Regardless of the exact method of detection of the key's movement, an electrical signal is produced when each of the keys is actuated, and in some conventional pianos, the velocity of the key's movement is additionally detected to vary the volume or some other characteristic of the tone to be produced by the sound engine of the electronic piano.

A relatively recent development is the combination of an acoustic piano and an electronic piano in which a single musical instrument can operate in two different modes: (1) an acoustic mode utilizing a standard piano action, and (2) an electronic mode utilizing a standard electric piano's components, however, also preventing the actuation of a portion of the acoustic piano's action, thereby inhibiting an acoustic tone from being generated. There are various types of conventional dual-mode pianos, some of which include the entire standard acoustic action of an upright piano, and others that only utilize a portion of a piano's action. For example, U.S. Pat. No. 4,679,477, by Monte, discloses a "silent" electronic keyboard that includes a pivoted "silent hammer," which has its momentum stopped by a "stop rail." The hammer is directly engaged by the key tail of the keys using a cam and follower action.

Another patent, by Nagai (U.S. Pat. No. 4,704,931), inhibits the vibration of the strings of a piano when operated in its "silent mode." A damper is placed against each of the strings so that when the hammer strikes the string, there will be little or no vibration. During normal acoustic playing mode, the damper is pivoted away from the strings, thereby allowing acoustic tones to be generated in the normal fashion.

An upright piano that includes a hammer-stopping mechanism that suppresses acoustic piano sounds is disclosed in Seiler (DE 37 07 591 C1). This hammer-stopping mechanism is referred to in Seiler as a "register rod" and has no effect on the normal operation of the acoustic action when the piano is operating in its acoustic mode. However, when the piano is operated in its "synthesizer" mode, this register rod intercepts the movement of the hammer shank so that the tip of the hammer cannot strike its corresponding string. The register rod is pivotable about a 90° angle between its actuated and non-actuated positions. As related above, in its non-actuated position, the register rod does not interfere with the hammer shank so that the hammer may strike the string when its corresponding key is operated. To actuate the register rod, one of its sides is pulled down or to the side so that the register rod pivots about a 90° angle such that its intercepting surface is placed in a position that will interfere with the movement of the hammer shank when its corresponding key is operated. By so interfering, the hammer shank is intercepted before it can complete its normal full travel, thereby preventing the hammer from completing its full travel and striking the string.

Another combination acoustic and electronic piano is disclosed in Yamaha (EP 0 573 963 A2), which includes a "stopper" that contacts the hammer shank before its corresponding hammer can strike the string. Yamaha discloses a "mechanical sound producing mode" (i.e., an acoustic mode) and an "electronic sound producing mode" (i.e., an electronic mode). The stopper is actuated between a "free position" and a "blocking position," in which the free position does not interfere with the normal operation of the key action so that the hammer may strike its corresponding string. In the blocking position, the stopper will contact the hammer shank before the shank reaches its normal end travel, thereby also preventing the hammer from reaching its end travel so that its corresponding string is not contacted by the tip of the hammer.

The stopper is mainly constructed of a rotatable shaft that is actuated by a motor. The shaft includes three brackets that protrude from one side of the shaft, much like the lobe of a cam. At the farthest tip of these brackets is a cushion that is designed to contact the hammer shank without unduly creating noise. When the stopper is in its "free position," the brackets are pointed in an upward, vertical direction so as to not interfere with the movement of the hammer shank as it approaches from the side. When in the "blocking position," the brackets, having been rotated 90° from the vertical to the horizontal, now intercept the hammer shank so that it cannot complete its normal travel. Each of the three brackets is designed to intercept the hammer shanks of one of the three portions of the piano keys, i.e., the bass, tenor (mid-range), and treble keys, which would correspond to the three different sections of the piano action.

The conventional hammer shank stopping mechanisms are not suitable for all configurations of upright pianos, particularly where the space requirements or connectivity requirements of a particular upright piano cannot be made compatible.

SUMMARY OF THE INVENTION

Accordingly, it is a primary object of the present invention to provide a dual-mode piano that utilizes a hammer shank stop rail to prevent the hammer from striking the string of a key action when used in the electronic mode while preserving the "touch" of an acoustic piano, yet allowing the hammer action to operate normally when operated in the acoustic mode, in which the hammer shank stop rail is actuated by an intermediate crank that is angled to be actuated by a dowel, and whereby the stop rail need only be rotated by a small angle to change positions between modes.

It is an additional object of the present invention to provide a dual-mode piano that utilizes a hammer shank stop rail to prevent the hammer from striking the string of a key action when used in the electronic mode while preserving the "touch" of an acoustic piano, yet allowing the hammer action to operate normally when operated in the acoustic mode, in which the hammer shank stop rail is actuated by a combination cable and cam actuator that is attached to a pedal, and whereby the stop rail need only be rotated by a small angle to change positions between modes.

It is another object of the present invention to provide a combination acoustic-mode and electronic-mode piano that utilizes a fluid-actuated hammer shank stop rail which operates under very low fluid pressure requirements, and does not require any intermediate crank or pedal dowel for its actuation, while preserving the "touch" of an acoustic piano during the electronic mode of operation.

It is a further object of the present invention to provide a combination acoustic-mode and electronic-mode piano that includes a spring-loaded actuator that disables the key action in the location of the key tail. This wippen-disabler, when actuated, raises the wippen to a position where it cannot be actuated by the key tail, and therefore the remaining downstream portions of the key action will also not be actuated, while preserving the "touch" of an acoustic piano during the electronic (and wippen-disabling) mode of operation.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved combination acoustic-mode and electronic-mode piano is provided including a hammer shank stop rail that intercepts the hammer shank, when in the electronic mode, so that the hammer cannot complete its normal travel and cannot strike its corresponding string(s) when its key is actuated. The hammer shank stop rail is actuated by an intermediate crank that, in turn, is actuated by a pedal dowel linked by means of a trap lever attached to one of the pedals of the piano. When operated in the acoustic mode, the intermediate crank is moved to its lowered position and relaxes its rotational forces against the hammer shank stop rail, thereby allowing the hammer shank stop rail to occupy a position that will not interfere with the hammer shank's movements. When in the electronic mode, the intermediate crank is raised by the pedal dowel to a position that forces the hammer shank stop rail to rotate by a small angle which brings the upper portion of the hammer shank stop rail, comprising a rubber-type insert or tube, into a position that will intercept the hammer shank when it is actuated by its corresponding key. When the hammer shank is intercepted by the rubber insert or tube of the hammer shank stop rail, it will not yet have completed its normal full travel, and its associated hammer will not be able to travel all the way into contact with their associated string. While in this mode, none of the strings of the piano will be able to be struck by any of their corresponding hammers, and the combination dual-made piano will then act strictly as an electronic piano.

As an optional feature, the combination acoustic-mode and electronic-mode piano can be simultaneously operated in both its acoustic and electronic modes, in which the piano's strings are being mechanically actuated by the piano action and the electronic piano features are also operating to provide an electrical signal output that can be communicated to a speaker or to a MIDI sound module. The normal pedal movement is not used in this circumstance, and the electronic output is turned ON by a separate switch.

In a second embodiment of a combination dual-mode piano, a hammer shank stop rail is provided which intercepts the hammer shank, when in the electronic mode, so that the hammer cannot complete its normal travel and cannot strike its corresponding string(s) when its key is actuated. The hammer shank stop rail is actuated by a combination cable and cam actuator that is attached to one of the pedals of the piano. When operated in the acoustic mode, the cable is allowed to be pulled upward by a coil spring (i.e., the pedal is not depressed and the cable can be moved upward). The cable is wrapped around a non-eccentric shaft portion of a cam, and in this position, the cam's eccentric lobe has its low portion abutting an L-bracket which, in turn, is attached to one of the longitudinal sides of the hammer shank stop rail, and thereby allows the stop rail to be pivotally moved to its non-engaging position. In this condition, the stop rail will not interfere with the normal travel of the various hammer shanks as they attempt to move their respective hammers into engagement with their strings, thereby allowing the piano to be played in its normal acoustic mode of operation. When operated in the electronic mode, the cable is pulled downward by the depressing of the foot pedal, thereby causing the camshaft to be rotated by a small angle (of about 90°) which, in turn, causes the high lobe portion of the eccentric lobe of the cam to abut the L-bracket. This forces the stop rail to be rotated by a small angle which brings the upper portion of the hammer shank stop rail, comprising a rubber-type insert or tube, into a position that will intercept the hammer shank when it is actuated by its corresponding key. When the hammer shank is intercepted by the rubber insert or tube of the hammer shank stop rail, it will not yet have completed its normal full travel, and its associated hammer will not be able to travel all the way into contact with its associated string. While in this mode, none of the strings of the piano will be able to be struck by any of their corresponding hammers, and the combination dual-made piano will then act strictly as an electronic piano. The same (as related above) optional feature of simultaneous operation in both acoustic and electronic modes can be accomplished in the second embodiment.

In a third embodiment of a combination dual-mode piano, the intermediate crank is actuated by a hand-actuator mounted beneath the keybed of the piano. The hammer shank stop rail is attached along one of its longitudinal sides to the intermediate crank such that, when operated in the acoustic mode, the intermediate crank is moved to its lowered position and causes the hammer shank stop rail to occupy a position that will not interfere with the hammer shank's movements. When in the electronic mode, the intermediate crank is raised by the pedal dowel to a position that causes the hammer shank stop rail to transversely move a small distance thereby bringing the upper portion of the hammer shank stop rail, comprising a rubber-type insert or tube, into a position that will intercept the hammer shank when it is actuated by its corresponding key. When the hammer shank is intercepted by the rubber insert or tube of the hammer shank stop rail, it will not yet have completed its normal full travel, and its associated hammer will not be able to travel all the way into contact with their associated string. While in this mode, none of the strings of the piano will be able to be struck by any of their corresponding hammers, and the combination dual-made piano will then act strictly as an electronic piano.

In a fourth embodiment of a combination dual-mode piano, an inflatable fluid-actuated hammer shank stop rail is located in a position similar to the mechanical hammer shank stop rail described hereinabove. The fluid-actuated hammer shank stop rail includes a rigid portion that provides support across the width of the piano and an expandable portion that is resilient and can be enlarged by the use of an internal fluid pressure. When the expandable portion is actuated by fluid pressure, its contact area intercepts the hammer shank before the associated hammer can strike its associated string. To actuate this combination piano in the electronic mode, one of the piano pedals is used to actuate a bellows, thereby increasing the fluid pressure within the fluid-actuated stop rail. When this occurs, the expandable portion of the hammer shank stop rail will expand to achieve a large enough size so that its contact area will be in the correct position to intercept the hammer shanks. When the combination piano is placed into its acoustic mode, the fluid pressure inside the expandable portion is released, by allowing the re-expansion of the bellows, and the expandable portion will deflate and contract to its original, relatively flat configuration. Once returned to its flat configuration, the expandable portion of the hammer shank stop rail will not be in a position to interfere with the normal travel of the hammer shank, thereby allowing the associated hammer to strike its associated string upon actuation of their associated key. A return spring is used to help re-inflate the bellows once the pedal is released, thereby placing the piano back into its acoustic mode. The same (as related above) optional feature of simultaneous operation in both acoustic and electronic modes can be accomplished in the fourth embodiment.

A fifth embodiment of a combination dual-mode piano is provided that utilizes a spring-loaded wippen-disabler to prevent the wippen from being actuated by the key tail when the associated key is struck. When this fifth embodiment is placed into its acoustic mode, the wippen-disabler is rotated into a position so as to not interfere with the normal action of the piano. When placed into the electronic mode, the wippen-disabler is rotated into a position in which one of its extended members is forced against the bottom portion of the wippen and raises the wippen high enough into a position so that the capstan screw of the key tail cannot come into contact with the bottom surface of the wippen. In addition, a different portion of the wippen-disabler will be rotated so that its associated spring will come into contact with the top of the key tail, thereby providing the person playing the piano with some mechanical feedback that will approximate the feel of a standard key action. The person playing the piano, hopefully, will not observe a noticeable change in the "feel" of the keyboard whether the piano is being played in its acoustic mode or its electronic mode. The same (as related above) optional feature of simultaneous operation in both acoustic and electronic modes can be accomplished in the fifth embodiment.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
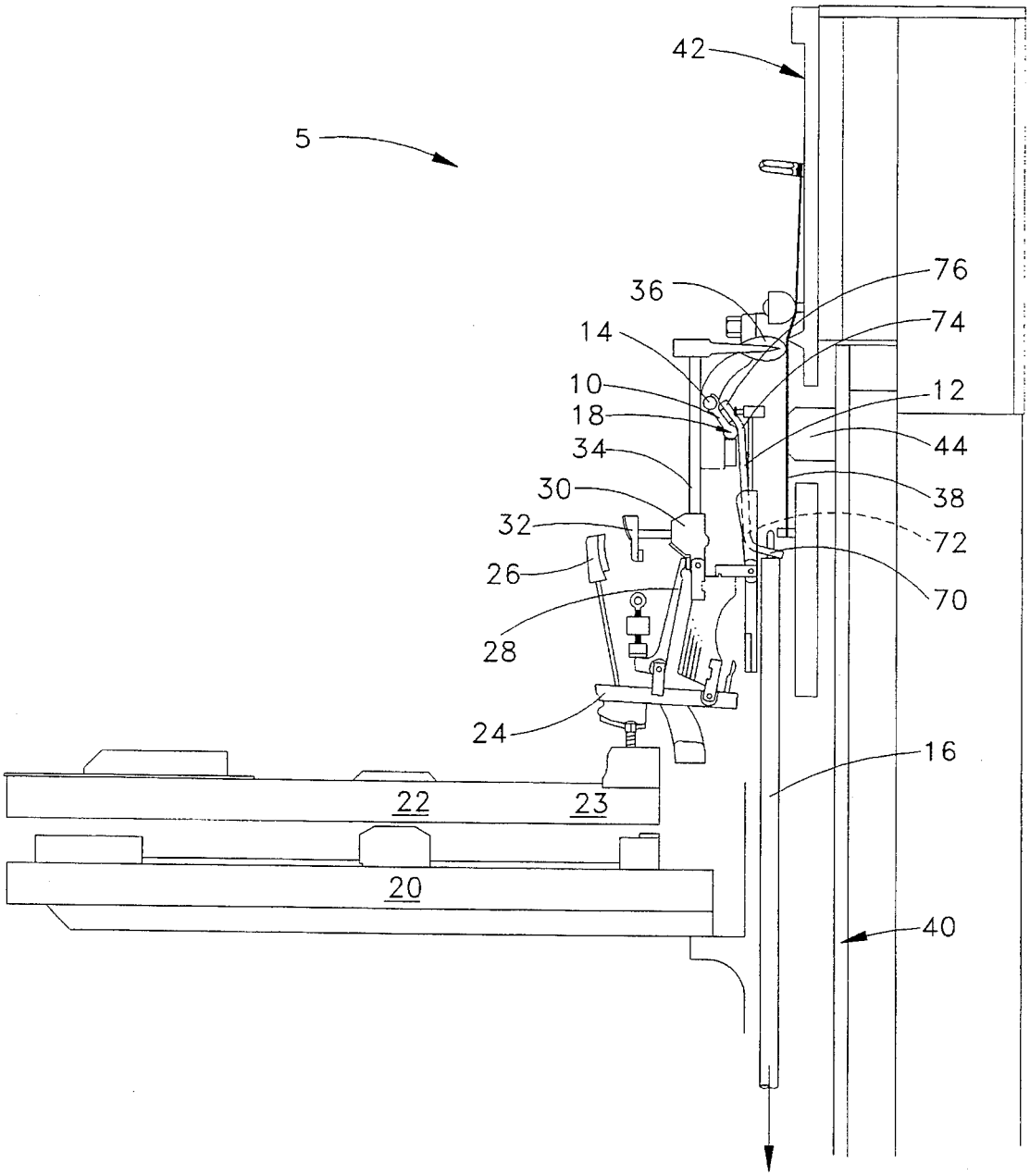
FIG. 1 is a side elevational view in partial cross-section of an upright piano having a mechanical hammer shank stop rail in its disengaged (or "acoustic-mode") position, and constructed according to the principles of the present invention.
Figure 4:
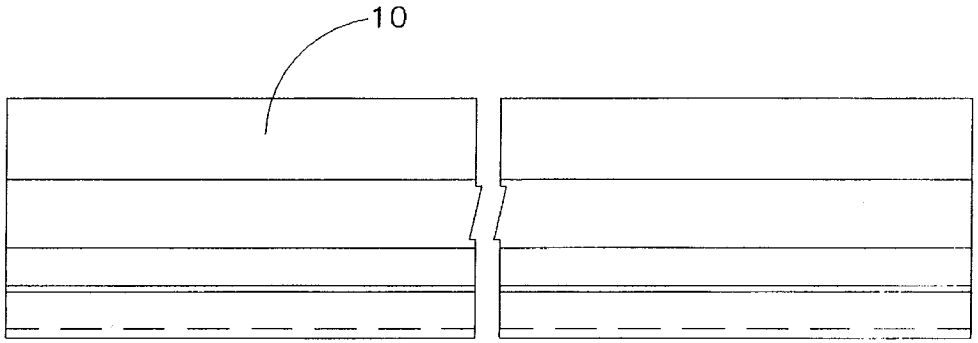
FIG. 4 is a top plan view of the hammer shank stop rail of FIG. 3.
Figure 3:
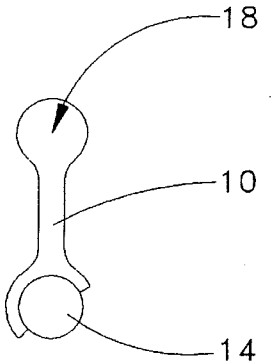
FIG. 3 is a cross-sectional view of the mechanical hammer shank stop rail of FIG. 1 showing the details of its contoured surfaces.

Referring now to the drawings, FIG. 1 shows an upright piano, generally designated by the number 5, which includes a hammer shank stop rail designated by the index number 10. Hammer shank stop rail 10 extends across the entire width of piano 5 (see FIG. 4) and is attached at one end to an intermediate crank 12. Crank 12 is further attached to a pedal dowel 16 that extends downward and is further linked by means of a trap lever to one of the foot pedals (not shown) of the piano. Hammer shank stop rail 10, as best illustrated in FIG. 3, includes a substantially circular end portion that can rotate about an axis, designated by the index number 18. At the opposite end of hammer shank stop rail 10 is located a rubber insert or tube, generally designated by the index number 14. This rubber insert or tube is the physical device that makes the contact with the hammer shank when piano 5 is placed into its electronic mode.

As seen in FIG. 1, an individual piano key 22 is located above a keybed 20, and when the key 22 is actuated, its key tail 23 is moved in the upward direction, thereby actuating a wippen 24. The remainder of the key action is conventional, and includes a backcheck 26, a jack 28, a hammer butt 30, a hammer butt heel 32 and a hammer shank 34. Hammer shank 34 is affixed to a hammer 36 that makes contact with its corresponding string 38 to cause a musical tone to occur when key 22 is struck by the human user. A number of strings are attached to a sounding board, generally designated by the index number 40. On a conventional piano, there are normally three (3) to five (5) sectional divisions of the action, i.e., one for each portion of the piano's range, typically for bass, tenor (mid-range), and treble notes. The bass strings typically run at a different angle and over the tenor section to a separate bridge. The division between the tenor and treble sections is to allow clearance for plate struts. In some cases, more than three divisions of the action are used to allow for additional plate struts.

In FIG. 1, piano 5 is configured for its acoustic mode, in which the pedal dowel 16 is in its lower position, crank 12 is in its lower, non-actuated position, and hammer shank stop rail 10 is in its non-actuated position in which its rubber insert or tube 14 does not prevent the hammer shank 34 from completing its normal full travel as its key 22 is actuated. As can be seen in FIG. 1, pedal dowel 16 has an attachment point, generally designated by the index number 70, between itself and crank 12. Crank 12 transmits the force produced by pedal dowel 16 to the hammer shank stop rail 10, and is configured as having an "S"-shape in which its extreme ends bend in opposite directions at two angled elbows, a lower elbow 72 that redirects its travel from horizontal toward nearly vertical, and an upper elbow 74 at which point the upper end portion of crank 12 becomes an actuation member 76. The actuation member 76 of crank 12 is affixed to hammer shank stop rail 10 at one end of stop rail 10's width along the front of piano 5. When crank 12 moves up or down, hammer shank stop rail 10 will also move with it.

Figure 2:
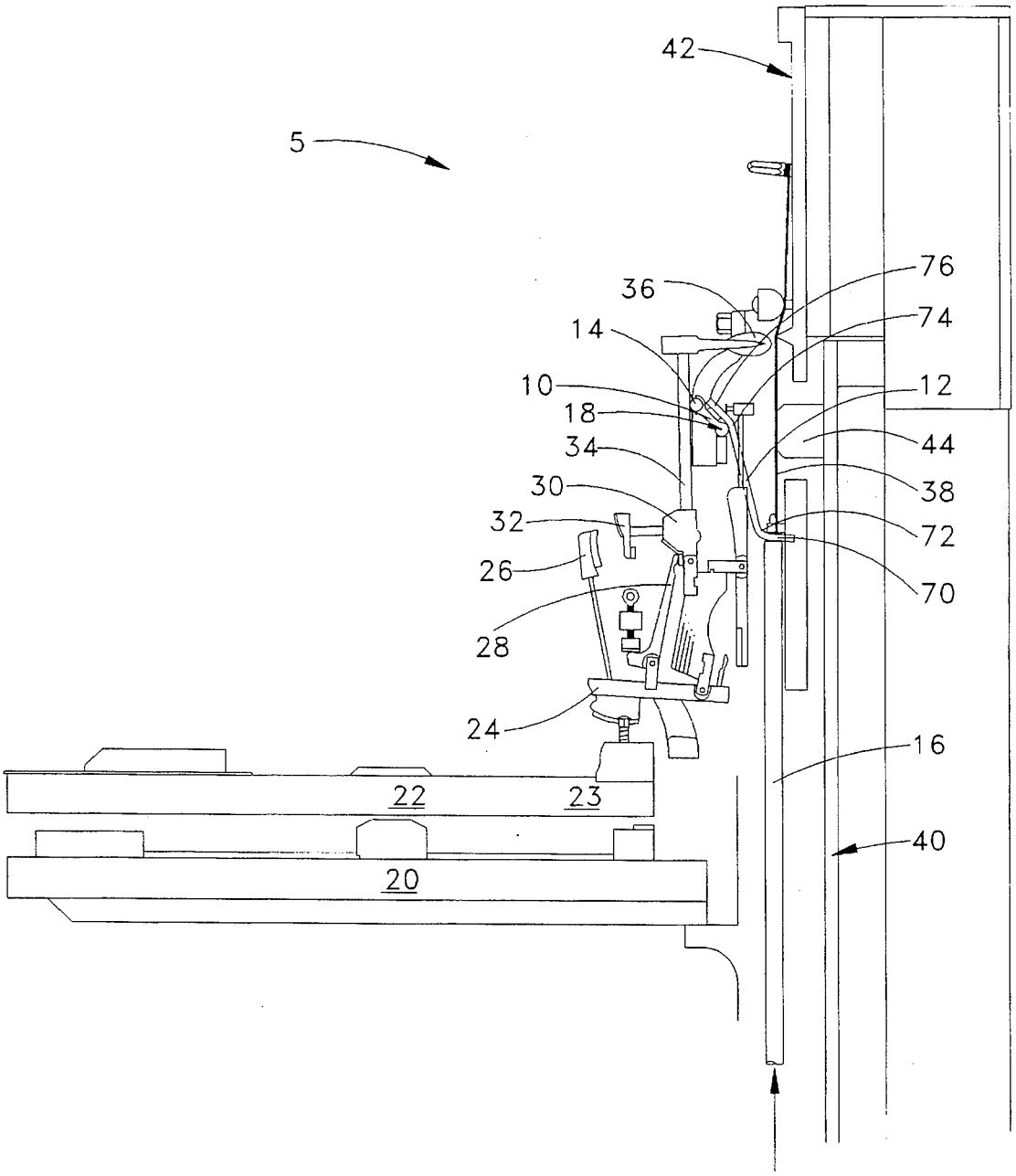
FIG. 2 is a side elevational view in partial cross-section of the mechanical hammer shank stop rail of FIG. 1, depicted in its actuated or "electronic-mode" position.

In FIG. 2, hammer shank stop rail 10 is depicted in its actuated, upper position, thereby placing piano 5 into its electronic mode, and preventing hammer 36 from striking its associated string 38. The pedal dowel 16 has been raised to its upper position by virtue of the human user having actuated its associated pedal (not shown). In this position, crank 12 is both raised and angled somewhat to the left (as seen on FIG. 2), thereby forcing hammer shank stop rail 10 to rotate in a counter-clockwise direction about its axis of rotation 18 (i.e., crank 12 also essentially rotates about axis of rotation 18). This counter-clockwise rotation places the rubber insert or tube 14 further to the left (as seen in FIG. 2), thereby intercepting the motion of the hammer shank 34 as it attempts to bring hammer 36 into a position where it can strike string 38. As can be easily seen by comparing FIGS. 1 and 2, the angle of rotation of hammer shank stop rail 10 is relatively small, and is much less than 90°. This makes for a reliable and quiet actuation of piano 5 as it is reconfigured from its acoustic mode into its electronic mode.

Piano 5 could be optionally operated in both its acoustic and electronic modes simultaneously, if desirable. To accomplish this simultaneous dual-mode, the pedal (not shown) is not actuated, so that pedal dowel 16 is not raised to its upper position. Crank 12 is not raised and does not force hammer shank stop rail 10 to rotate in a counter-clockwise direction about its axis of rotation 18, thereby allowing piano 5 to operate in its "normal" acoustic mode. A different actuating mechanism, such as an electrical switch (not shown) is operated by the human user to turn on the electronics (not shown) in the keyboard, so that an electrical signal output is provided for each of the keys 22 that are depressed by the user. This electrical signal output can be converted to an audio signal and communicated to a speaker or headphones (not shown), or can be communicated to a MIDI sound engine or sound module for other signal processing, if desired. As is easily understood, the electrical signal output will occur virtually simultaneously with the acoustic vibrations of the individual strings 38 of piano 5, which is the essence of this "dual" mode of operation.

Figure 6:
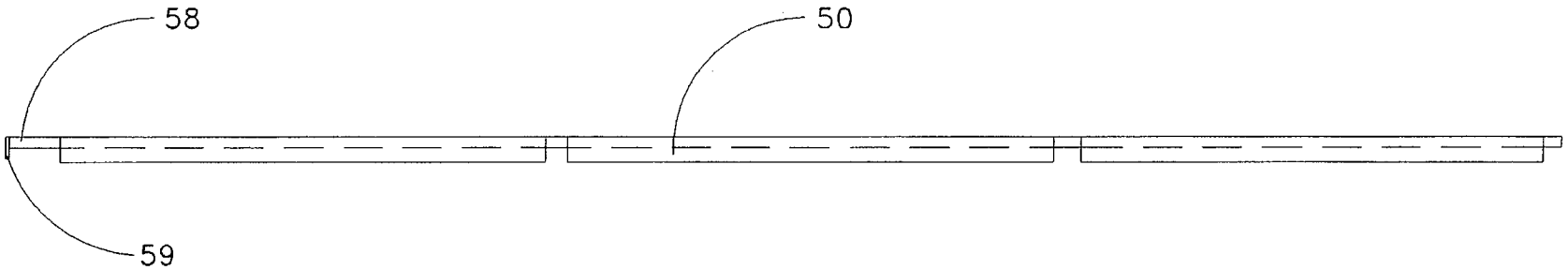
FIG. 6 is a top plan view of the alternative construction hammer shank stop rail of FIG. 5.
Figure 5:
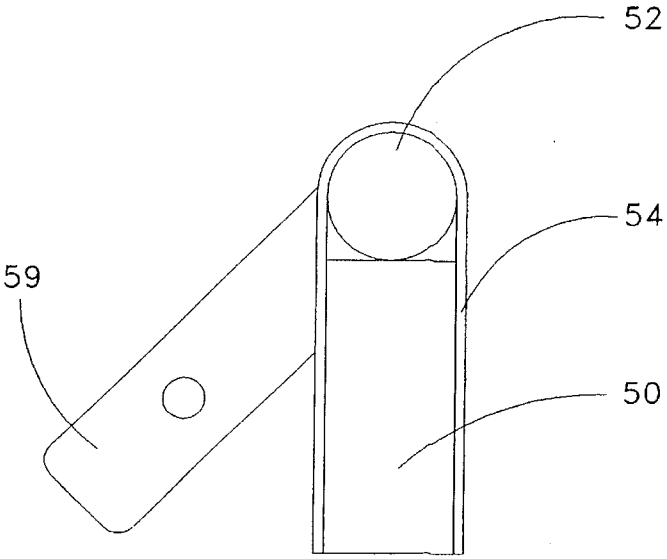
FIG. 5 is a cross-sectional view of an alternative construction hammer shank stop rail.

An alternative embodiment of hammer shank stop rail 10 is depicted in FIGS. 5 and 6, and is generally designated by the index number 50. The alternative embodiment stop rail 50 operates in a similar manner to the hammer shank stop rail 10 described hereinabove. The major difference is its construction which is of a hard hammer felt-type material, overlaid by a lining of a felt wrapper 54, and attached to a steel rod designated by the index number 52. These materials are in contrast to hammer shank stop rail 10 which preferably is constructed of aluminum, except for the rubber insert or tube 14. FIG. 6 illustrates the entire width of the alternative embodiment of hammer shank stop rail 50 including a copper-plated steel rod 58 that is used for the pivot action required when actuated from the acoustic mode to the electronic mode, and vice versa. Stop rail 10 is actuated by rotation of a lever 59, as depicted on FIGS. 5 and 6.

Figure 7B:
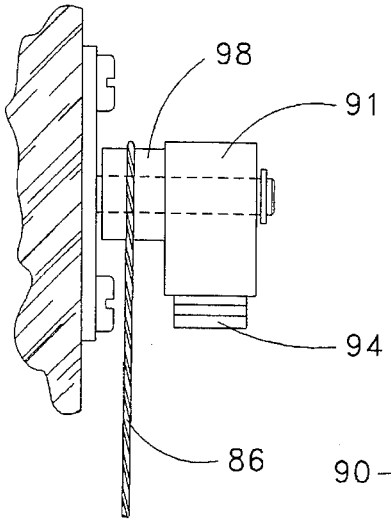
FIG. 7B is a front elevational view of the hammer shank stop rail of FIG. 7A.
Figure 7A:
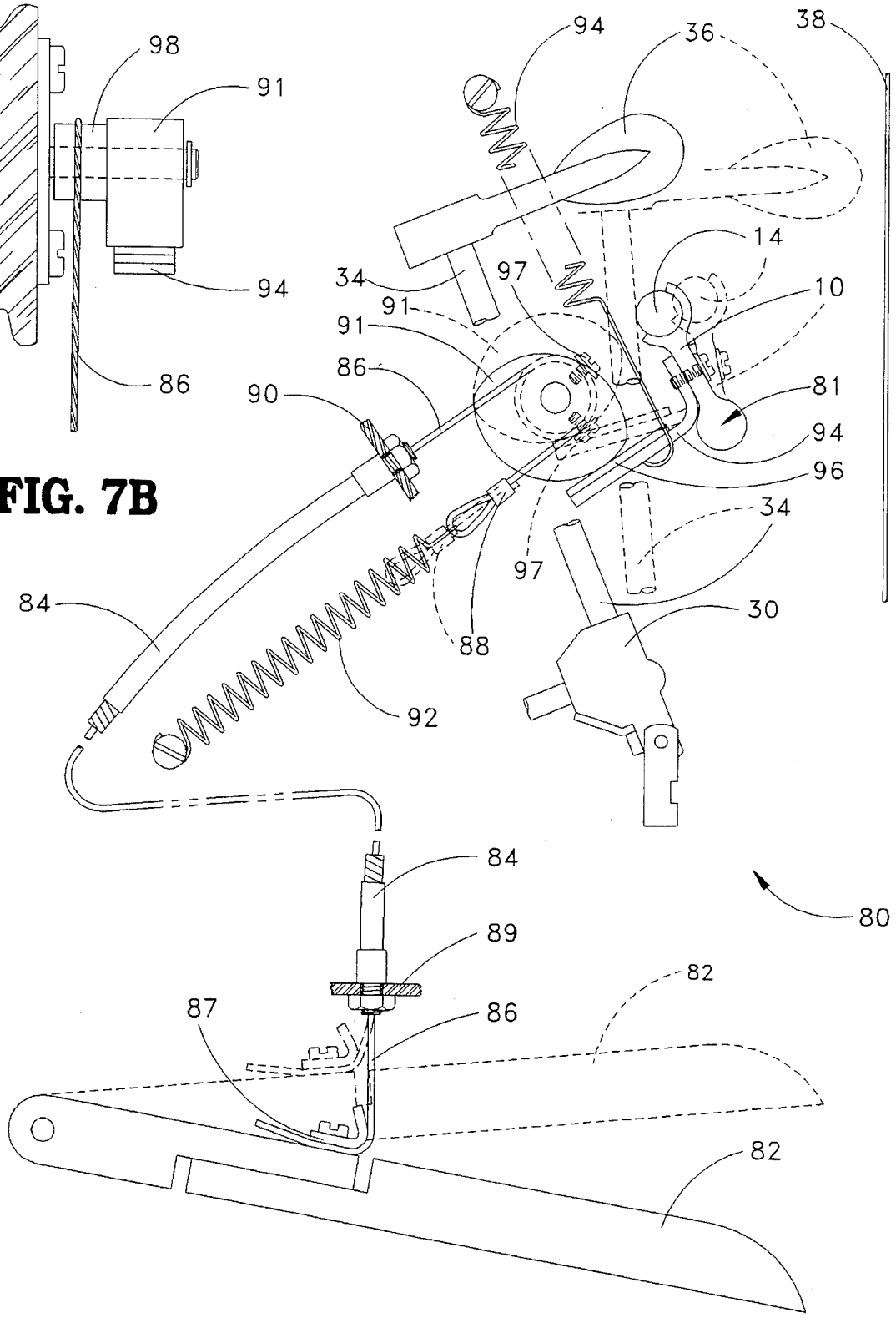
FIG. 7A is a cross-sectional view of another alternative construction hammer shank stop rail having a combination cable and cam actuator.

FIG. 7A depicts another alternative construction hammer shank stop rail, generally designated by the index numeral 80, having a combination cable and cam actuator. The cable-cam sub-assembly 80 is actuated by a pedal 82, via a flexible cable 86. Cable 86 runs through a jacket 84 between two stationary brackets 89 and 90. Cable 86 is fixed at its lower end attachment point, designated by the index numeral 87, near the lower stationary bracket 89. Cable 86 is attached at its opposite end to a coil spring 92 via a loop formed in the cable and held by a clamp 88 at the cable's end attachment point 88, extending past the upper stationary bracket 90.

Cable 86 is wrapped around a round, non-eccentric shaft 98, which is a portion of an eccentric cam 91. Cable 86 also is fixed at an attachment point designated by the index numeral 97, which preferably is a screw and clamp mechanism. In this way, when pedal 82 is depressed, cable 86 will be pulled in a downward direction (at its lower end attachment point 87), thereby rotating cam 91 (via its round shaft 98) by an angle of about 90°.

The upper end of cable 86 is spring-loaded by use of a coil spring 92 that has an extension that protrudes through the eye in the loop at the upper cable end attachment point 88. When pedal 82 is released (i.e., is placed into its upward position), spring 92 will tend to pull cable 86 into its non-actuated position, which is depicted in phantom lines on FIG. 7A. In this position, an L-bracket, designated by the index numeral 94 would have its wear surface abutting the lower lobe of cam 91 and would allow stop rail 10 to move to its non-actuated position, in which hammer 36 would be able to strike string 38. The wear surface 96 of L-bracket 94 is preferably made of a sound-deadening material such as felt.

When pedal 82 is depressed, cable 86 will rotate cam 91, via its attachment point 97 on the non-eccentric round shaft 98 (see FIG. 7B), so that the wear surface 96 of L-bracket 94 will become abutting against the high lobe portion of cam 91. When this occurs, L-bracket 94 becomes an actuating member that pulls the end of a second coil spring 94 in a downward direction, and additionally, pulls stop rail 10 downward and to the left (as viewed in FIG. 7A), so that stop rail 10 tends to pivot or rotate about its axis of rotation 18. The rubber insert or tube 14 will then be placed in a position to intercept the hammer shank 34 at a location that prevents the hammer 36 from striking its respective string 38. Spring 94 is designed to assist the movement of the L-bracket 94 into its non-actuated position when pedal 82 is allowed to be raised to its normal position. It will be understood that many other configurations of the cable-cam sub-assembly 80 could be constructed without departing from the principles of the present invention. One obvious modification would be to actuate the cable by a hand control rather than by a foot control.

Figure 9A:
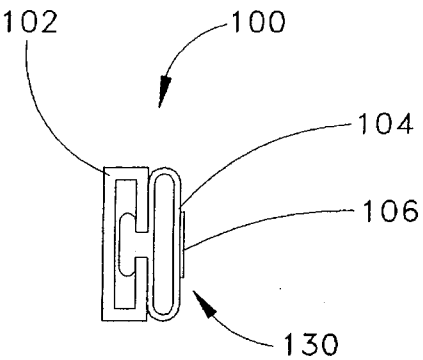
FIG. 9A is a side elevational view in cross-section showing the construction details of the fluid-actuated hammer shank stop rail of FIG. 8, in its non-actuated, non-expanded configuration.
Figure 9B:
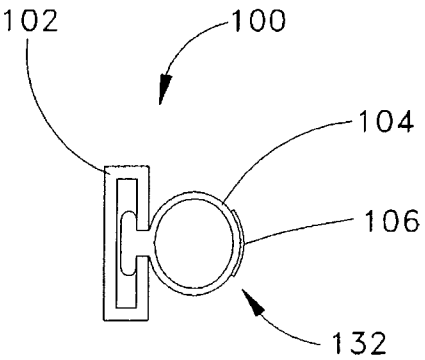
FIG. 9B is a side elevational view in cross-section of the fluid-actuated hammer shank stop rail of FIG. 9A, however, being depicted in its actuated, expanded configuration.
Figure 8:
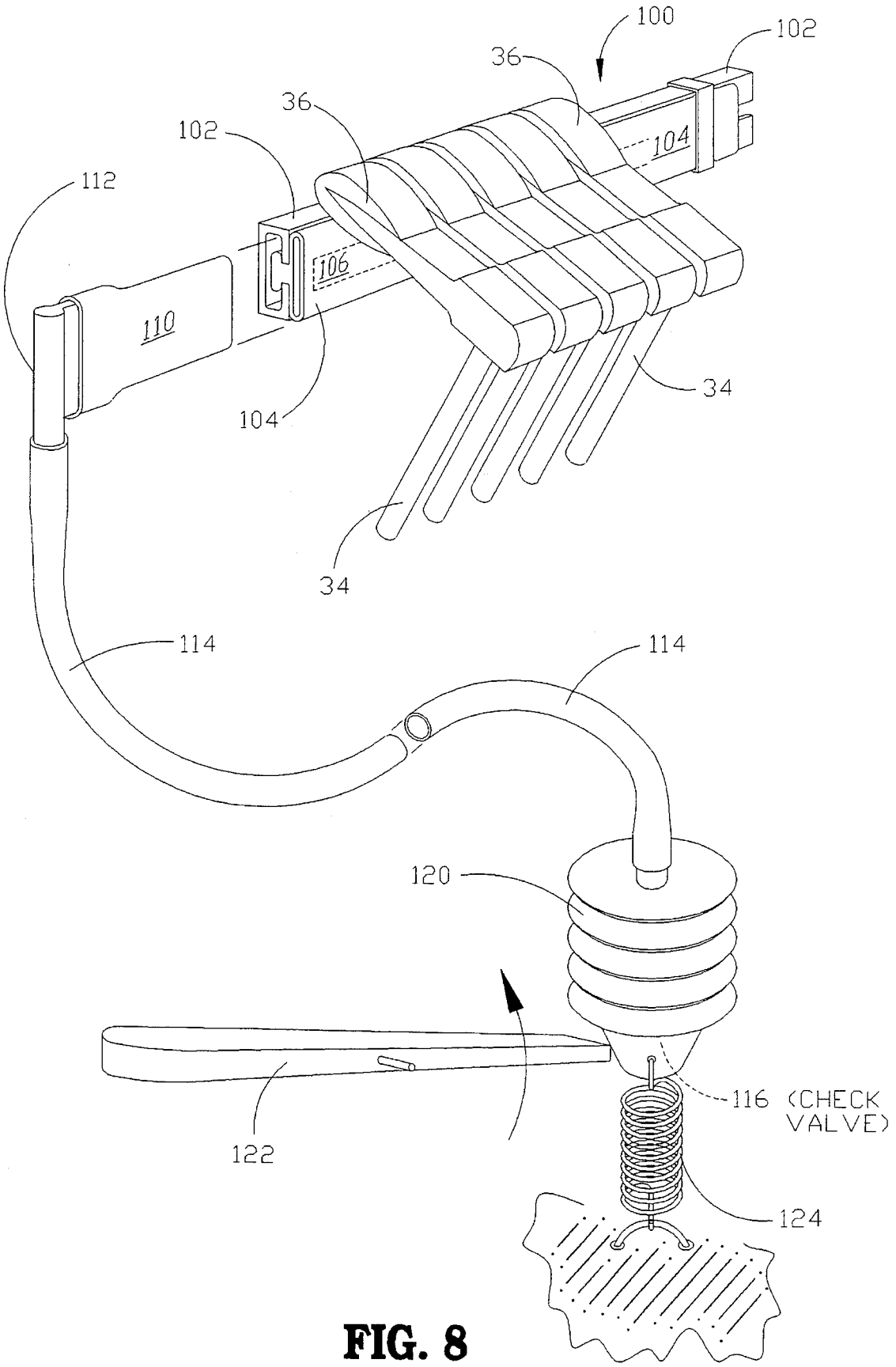
FIG. 8 is a perspective view of a fluid-actuated hammer shank stop rail system used in a combination dual-mode piano that can operate in either an acoustic mode or an electronic mode, and constructed according to the principles of the present invention.

FIG. 8 shows a fluid-actuated hammer shank stop rail, generally designated by the index number 100, which comprises a rigid rectangular portion 102 that preferably is made of a metal material and is formed in the shape of a rail (see FIGS. 8A and 8B), and a resilient, expandable portion 104 that preferably is made of a silicone rubber material. FIG. 9A depicts fluid-actuated stop rail 100 in its relaxed, non-expanded position, which is configured so as to not interfere with the normal travel of the hammer shank 34. FIG. 9B depicts fluid-actuated stop rail 100 in its expanded, actuated configuration, which is designed to intercept the hammer shank 34 before it completes its full travel upon the actuation of its associated key. The contact surface of expandable portion 104 is depicted by index number 130 in its non-inflated position, and by index number 132 in its inflated (actuated) position.

In a fluid-actuated embodiment, if expandable portion 104 is constructed of a rigid enough material, then hammer shank 34 will make contact with the stop rail at the contact surface 132 and will be stopped from completing its full travel at a point that prevents hammer 36 from striking string 38 (not shown in FIG. 8). Of course, expandable portion 104 should not be so rigid that it cannot be easily "blown up" like a balloon upon actuation of piano 5 into its electronic mode, so some care must be taken when selecting this material.

If the fluid medium is gaseous (such as air), it is preferred that either a separate thin wall of plastic material, generally designated by the index number 106, be placed on the contact area to act as a reinforcement along the entire length of fluid-actuated hammer shank stop rail 100, or that some fine wires or threads of a stiffening material be enmeshed in the outer wall at contact surface 132 of expandable portion 104 to provide the required rigidity. Without this rigidity, the hammer shank 34 will continue to travel even after it makes contact with expandable portion 104 at its inflated contact surface 132, and hammer 36 will strike the string, thereby defeating the purpose of the fluid-actuated hammer shank stop rail 100.

If the fluid medium is a liquid (such as water), no stiffening structure such as thin wall 106 or threads of stiffening material will be required. Fluid-actuated hammer shank stop rail 100 will be rigid enough to prevent the continued travel of the hammer shank 34, and will thereby prevent the hammer 36 from striking the string.

Fluid-actuated hammer shank stop rail 100 is actuated by the use of a relatively low fluid pressure within the interior of expandable portion 104. The piano pedal, designated by the index number 122, that is actuated by the human user is used to directly actuate and compress a bellows 120, thereby forcing fluid pressure into connecting flexible tubing 114. The pedal 122 preferably has a locking mechanism so that the human user need not continue to place force upon the pedal during the entire time period that piano 5 is operating in its electronic mode.

Pressure follows through flexible tubing 114 into a right-angle elbow 112 which is fluid-tight and further passes the increased fluid pressure into a plastic connector/adaptor, designated by the index number 110. Connector/adaptor 110 is then assembled into the interior area of expandable portion 104, of fluid-actuated hammer shank stop rail 100.

An exemplary bellows operating in this system depicted in FIG. 8 would be about two inches in diameter and would be pre-inflated with about five to six cubic inches of fluid to inflate the bellows at the time the dual-model piano 5 is shipped from the factory. When the bellows is compressed by the action of pedal 122, the increase in fluid pressure is only about one to two pounds per square inch (PSI), which will be sufficient to inflate the expandable portion 104 of fluid-actuated hammer shank stop rail 100.

When pedal 122 is de-actuated, thereby placing piano 5 into its acoustic mode, it is preferred that a return spring 124 be used to help re-expand bellows 120. In addition, one optional improvement would be to add a check valve 116 to equalize atmospheric pressure, if the stop rail of piano 5 is pneumatically operated.

Figure 10:
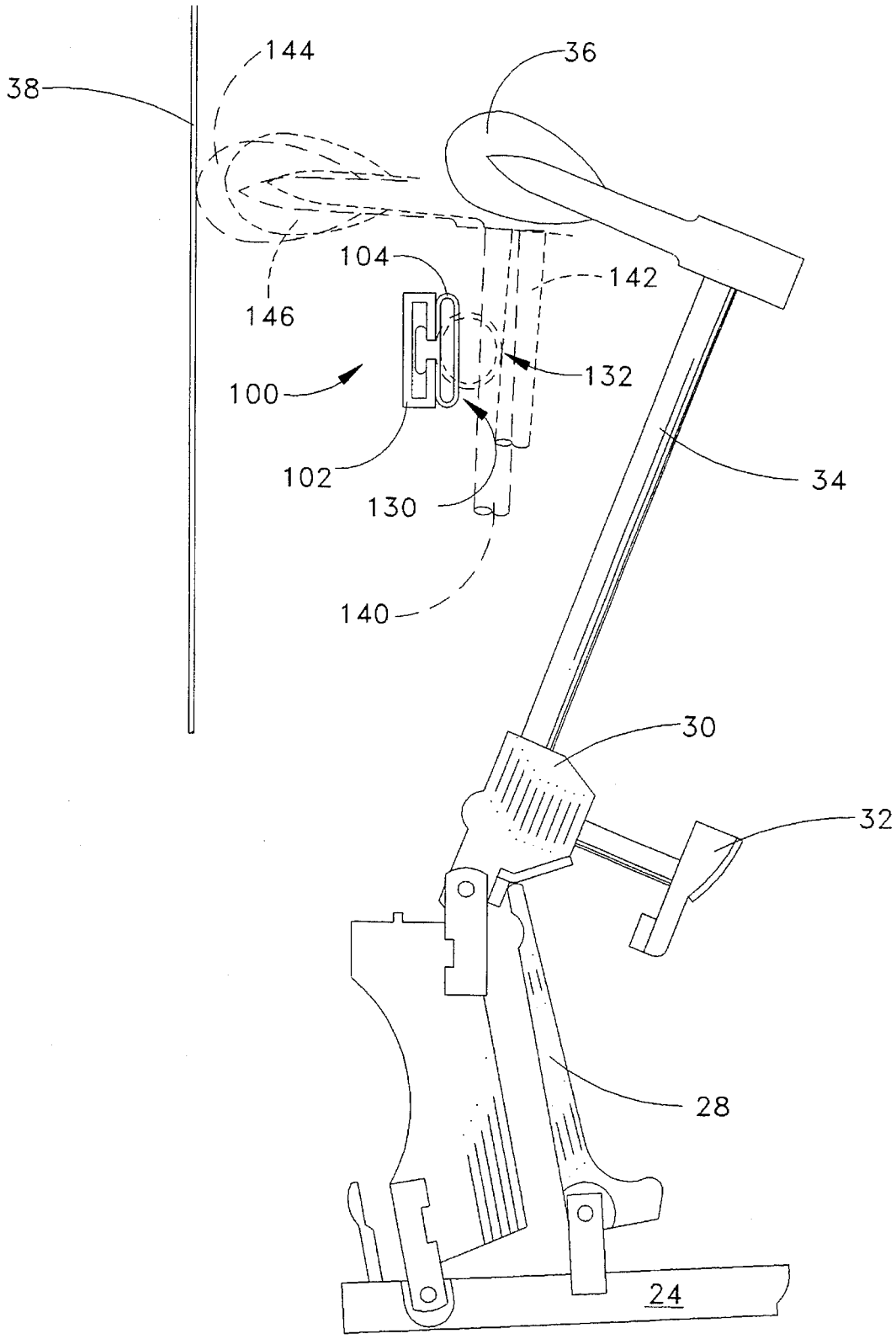
FIG. 10 is a side elevational view of the details of a portion of the key action in the area of the fluid-actuated hammer shank stop rail of FIG. 8.

FIG. 10 shows the exact location that fluid-actuated hammer shank stop rail 100 is preferably positioned with respect to the end travel positions of the hammer shank 34. When expandable portion 104 is not inflated, its contact surface position 130 is relatively flat, as seen by the solid lines on FIG. 10. Hammer shank 34 and hammer 36 are depicted in solid lines on FIG. 10 when in their relaxed, non-actuated positions (i.e., when their corresponding key has not been struck by the human user), and by phantom lines when hammer shank 34 is at its normal end travel position 140 and the hammer is at its end travel position 144 against string 38, after their associated key has been actuated by the human user.

Fluid-actuated hammer shank stop rail 100 is also shown in its actuated position in dashed lines in which its expandable portion 104 is inflated to its contact surface position 132. In this configuration, hammer shank 34 is also shows in dash lines at its end travel (in the "inflated" mode), generally designated by the index number 142. When the hammer shank is in this position 142, its corresponding hammer will be in the position depicted by the index number 146, also seen in dashed lines on FIG. 10. As can be easily seen, the hammer will not strike string 38 when operated in this configuration. It will be understood that other configurations are available in constructing an inflatable stop rail without departing from the principles of the present invention.

Figure 11:
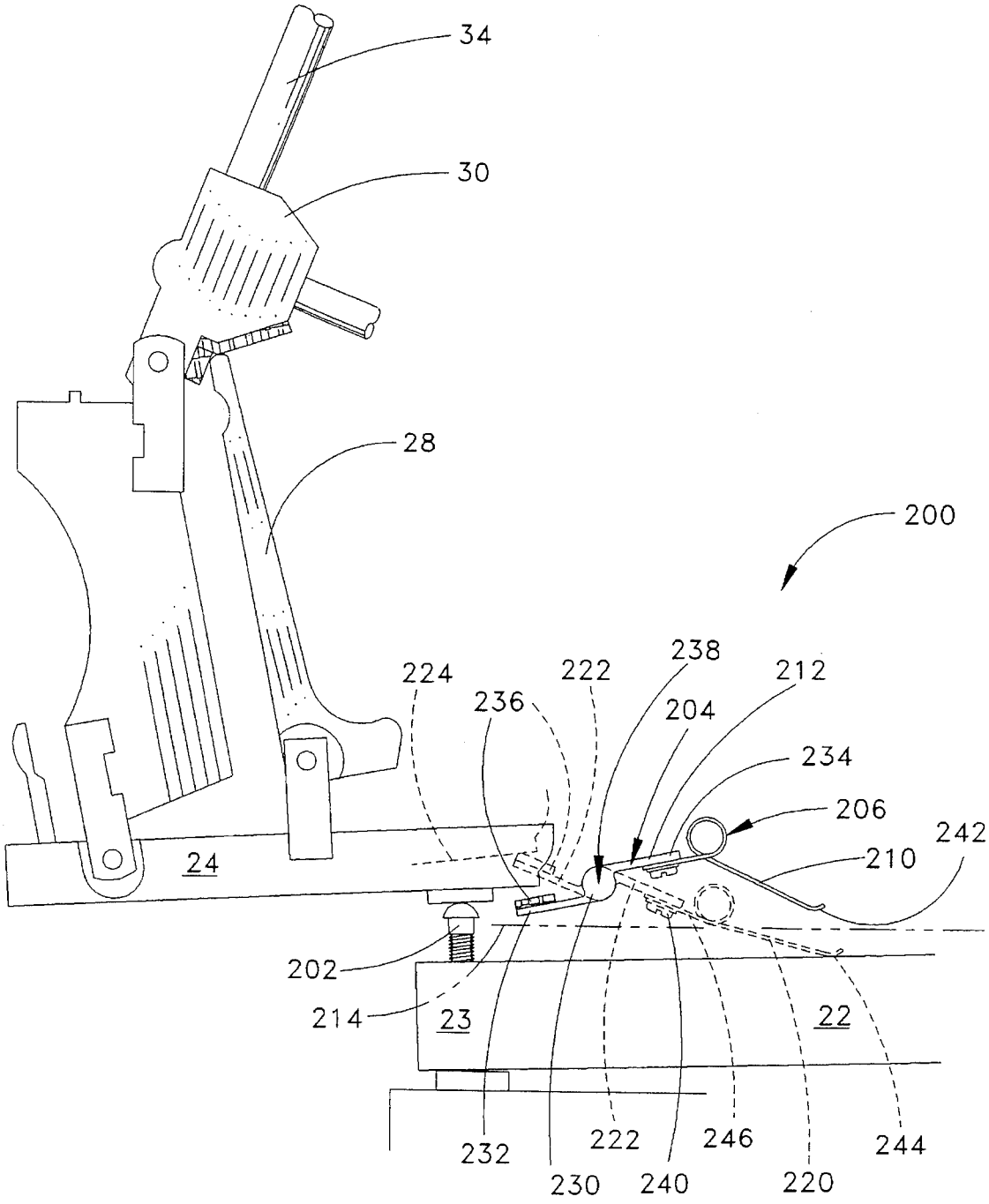
FIG. 11 is a side elevational view depicting a spring-loaded wippen-disabler useful for a combination dual-mode piano having an acoustic mode and an electronic mode and constructed according to the principles of the present invention, and showing the wippen-disabler in both its non-actuated "acoustic-mode" position and in its actuated, "electronic-mode" position (in phantom lines).

Another method of preventing a hammer from striking its associated string upon actuation of its associated key is depicted in FIG. 11. In this configuration, the hammer shank 34 is not intercepted in its travel, but instead the wippen 24 is raised out of its normal position so that the key tail 23, via its capstan screw 202, cannot contact the bottom surface of the wippen 24. This is accomplished by the use of a rotatable "wippen-disabler," generally designated by the index number 200. Wippen-disabler 200 is mainly comprised of two components, a torsion spring 206 and an actuator 204. Spring 206 and actuator 204 are depicted in solid lines in their non-actuated (acoustic-mode) positions in FIG. 11 as index numerals 210 and 212, respectively, and are depicted by phantom lines in their actuated (electronic-mode) positions as index numerals 220 and 222, respectively.

As can be easily seen in FIG. 11, actuator 204 can be rotated about an axis of rotation 238, and in its non-actuated (acoustic-mode) position, the actuator has two extensions or arms, generally depicted by the index numerals 232 and 234. The preferred material for actuator 204 is extruded aluminum. Actuator 204 is attached to spring 206 by a fastener 240. Spring 206 includes a leg or "spring end" depicted by the index number 242, which is not engaged against any surface, and the extension or arm 232 of actuator 204 does not come into contact with the wippen when they are in their non-actuated positions 210 and 212. Key tail 23 is shown in solid lines when key 22 is not actuated by the human user, and by the phantom line 214 when the key is actuated. As can be seen in FIG. 11, key tail 23 will not come into contact against any portion of actuator 204 when the actuator is in its non-engaged position 212.

Actuator 204 is rotated via a mechanism that is not shown in FIG. 11, preferably by the use of one of the piano's pedals. This mechanism rotates actuator 204 about an axis of rotation 238 which is located approximately at the center of the actuator's central portion 230. It will be understood that a means for rotating this actuator 204 is well understood by those of ordinary skill in the art. One obvious mechanism would be to insert a rod throughout the actuator central portion 230 that is engaged by some type of pedal dowel, similar to that shown in FIG. 1. Once actuator 204 is engaged, it will move to its engaged position 222, shown in phantom lines in FIG. 11. The actuator extension or arm 232 (on the side facing wippen 24) will be pressed against the bottom of the wippen 24 via an engagement felt pad 236. This will raise the wippen to an elevation, depicted by the index number 224 in phantom line, so that it will not be touched by the capstan screw 202 when the key tail 23 is moved upward due to actuation of the key 22 by the human user.

When in this actuated position, actuator 204 causes spring 206 to move to its engaged or actuated position 220. When this occurs, spring 206 is flexed, such that its engaged leg or spring end 244 is pressed against the top of the key tail 23, while its opposite leg or spring end 246 remains attached to the actuator 204 at its extension or arm 234 (on the end away from the wippen). As can be seen in FIG. 11, both legs 244 and 246 are in near linear alignment in this mode, and a spring force will be applied at the leg 244 against the top of the key tail 23. This spring force will approximate the weight of the key action of the piano when in its normal acoustic mode, thereby providing the human user with a "feel" of the key action, while in the electronic mode. The choice of the material and thickness for the spring 206 is important so as to maintain as consistent a feel between the electronic mode and the acoustic mode as possible, and the preferred material is steel wire.

It should be noted that the amount of time to implement a change of operation mode from acoustic mode to electronic mode should be made long enough to not forcefully urge the wippen 24 upward too quickly. Otherwise, all 88 tones of the piano will simultaneously be sounded when all 88 hammers 36 are caused to strike their respective strings 38, thereby defeating rather dramatically the purpose of the "silent" electronic mode.

It will be understood that other configurations for actuator 204 and spring 206 can be constructed without departing from the principles of the present invention. One such alternative configuration would be where actuator 204 is constructed of many individual segments, one per each key of the piano, preferably all actuated at one time, or at least in certain groupings. Another such alternative configuration would be where spring 206 has an adjustable position or spring rate, or is constructed as one piece for the entire piano in one elongated structure extending longitudinally above all of the keys. Furthermore, a different type of spring could be used in lieu of a torsion spring, such as a compression spring or a coil spring.

Figure 12:
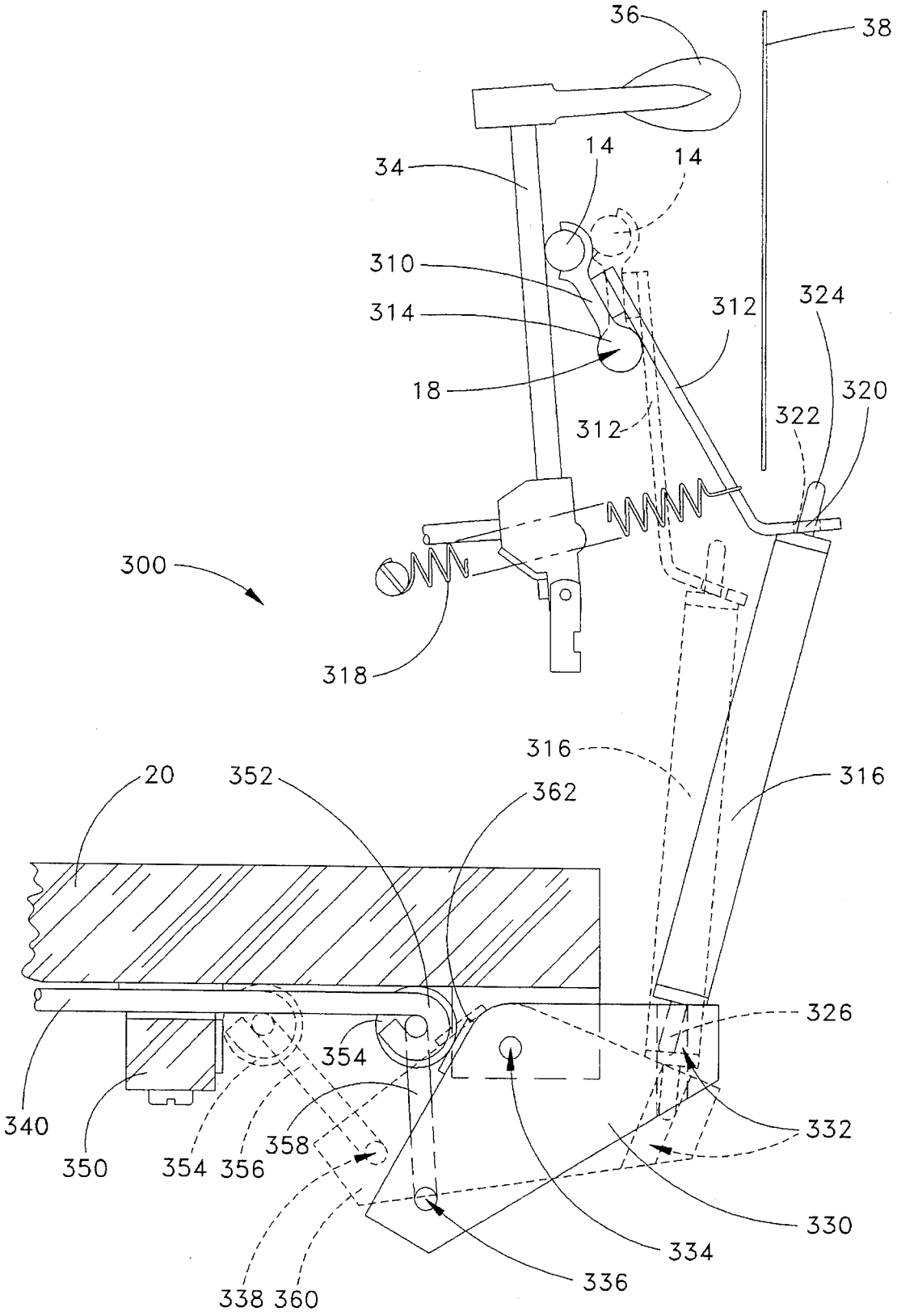
FIG. 12 is a side elevational view in partial cross-section depicting a portion of an upright piano having a mechanical hammer shank stop rail operated by a hand-actuator mounted beneath the keybed showing the keybed construction details, and constructed according to the principles of the present invention.

FIG. 12 depicts yet another configuration of a mechanical hammer shank stop rail that uses a hand actuator rather than a foot pedal actuator. In this configuration, a stop rail sub-assembly, generally designated by the index number 300, is actuated by another crank 330, which in turn, is actuated by a hand-actuator rod 340 (see also FIG. 13). By use of this hand actuator system, all of the foot pedals are available for other uses in controlling the functions of the piano.

Stop rail sub-assembly 300 includes a stop rail, designated by the index numeral 310, that utilizes a rubber insert or tube 14 to intercept the hammer shank 34 before allowing the hammer 36 to strike its respective string 38. Stop rail 310 pivots about its axis 18, and stop rail 310 is attached along its length between the rubber insert 14 and its end portion 314 to an intermediate crank 312, preferably by using two or more fasteners along the surface length of stop rail 310. Intermediate crank 312 is attached to a coil spring 318 which serves to return stop rail 310 to its inactive position (as depicted in phantom lines on FIG. 12). Located at the lower end of intermediate crank 312 is its attachment point 320 to a dowel 316. Intermediate crank 312 has a through-hole 322 through which a top pin designated by the index numeral 324 of dowel 316 protrudes. At the lower end of dowel 316 is a bottom pin 326 that protrudes into a hollow opening 332 of the other crank 330.

Figure 13:
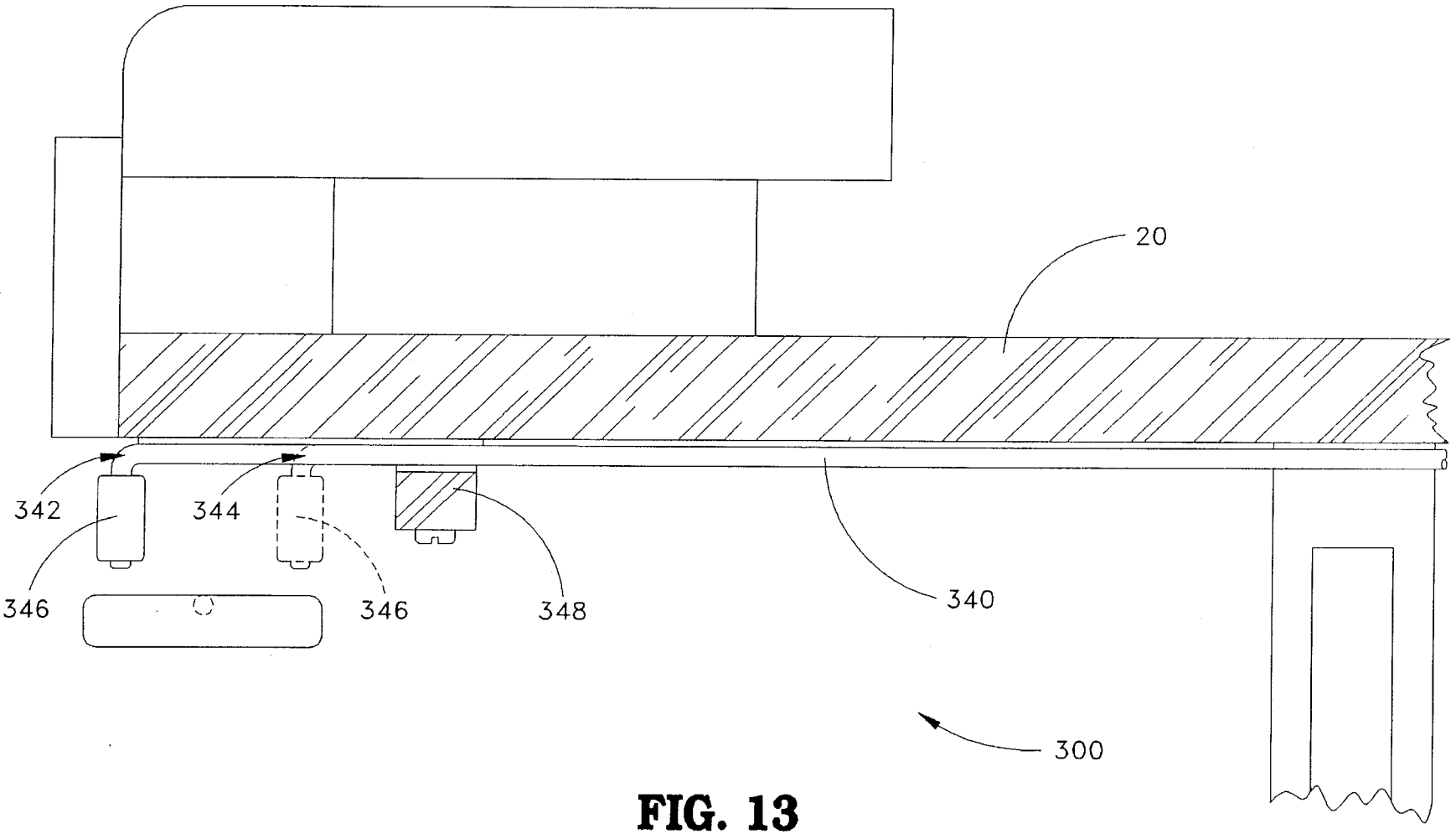
FIG. 13 is a side elevational view in partial cross-section depicting a different portion of the upright piano with mechanical hammer shank stop rail of FIG. 12, showing the stop rail and associated operative linkage construction details.

Hand-actuator rod 340 is linearly displaceable in the horizontal plane beneath the keybed 20 of the upright piano 5. The end of rod 340 can be moved to an extended (pulled) position designated by the index numeral 342, and then to a normal position designated by the index numeral 344. A handle 346 would preferably be provided at the end of rod 340. Rod 340 is supported by linearly slidable attachment points, preferably by a linear bearing block 348 near the handle 346 of rod 340, and by a second linear bearing block 350 located near its opposite, inner end. FIG. 13 depicts the details of the piano keybed 20 and the end positions 342 and 344 of rod 340.

Referring to FIG. 12, the inner end, designated by the index numeral 352, of rod 340 is preferably rounded so that it can hold in place a pivot pin about which a wheel 354 can rotate. Wheel 354 performs two functions: (1) it provides a bearing surface against the bottom of keybed 20; and (2) it provides an abutting and actuating surface against a wear surface designated by the index numeral 362 of crank 330. Wear surface 362 would preferably comprise a sound deadening material such as felt.

Crank 330 is pivotally movable about a pivot axis 334, and its pivoting motion is induced by a toggle link which is depicted by the index numeral 358 in its normal, non-actuated position, and by the index numeral 356 in its extended, actuated position. In its normal position, toggle link 358 is pivotally attached to crank 330 at the point designated by the index numeral 336 on FIG. 12. In its actuated position, toggle link 356 is pivotally attached to the same point of crank 330, however, crank 330 is now moved to its actuated position depicted by the index numeral 360, and toggle link 356 has this end pivotally attached to the point designated by the index numeral 338 on FIG. 12.

In this actuated position, dowel 316 is moved to a lower position, thereby allowing intermediate crank 312 and its attached hammer shank stop rail 310 to be rotated in the clockwise direction about axis 18 (as viewed in FIG. 12) and to allow the hammer shank 34 to travel throughout its normal travel until its corresponding hammer 36 strikes its respective string 38. The positions of toggle link 356, crank 360, intermediate crank 312, and stop rail 310 are shown in phantom lines on FIG. 12 when in their actuated positions. It will be understood that various other configurations of a hand-actuated mechanism could be utilized to move the hammer shank stop rail 310 between its actuated and non-actuated positions without departing from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A hammer shank stop rail mechanism for use in a piano and actuated by a control of the piano, said piano having a conventional keyboard and a conventional key action for each key, including a plurality of hammer shanks, hammers, and strings, said hammer shank stop rail mechanism comprising:

(a) a pedal dowel having a longitudinal body terminating in first and second ends, and extending substantially vertically within said piano, said first end being actuated by said control, wherein said pedal dowel is movable between a first, non-actuated position and a second, actuated position;

(b) an intermediate crank having a first end operatively attached to the second end of said pedal dowel and extending from the second end of said pedal dowel toward a second end of the crank, the second end of said crank being angled, said crank being movable by said pedal dowel between a first, non-actuated position and a second, actuated position; and (c) an elongated hammer shank stop rail having longitudinal first and second sides and longitudinal first and second edges terminating in first and second ends, said stop rail being pivotally mounted along a longitudinal axis of rotation, the angled second end of said crank engaging one of the sides of said stop rail, said crank being rockable by said pedal dowel to pivot said stop rail between a first, non-actuated position and a second, actuated position, the first longitudinal edge of said stop rail, when in its actuated position, being positioned within the path of travel of said hammer shanks thereby preventing said hammers from striking their respective strings, the first longitudinal edge of said stop rail, when in its non-actuated position, being positioned outside the path of travel of said hammer shanks thereby allowing said hammers to strike their respective strings, the first longitudinal edge of said stop rail being constructed of a material to quietly receive an impact from said hammer shanks.

2. The hammer shank stop rail mechanism as recited in claim 1, wherein the axis of rotation of said stop rail is located proximal to said second longitudinal edge.

3. The hammer shank stop rail mechanism as recited in claim 1, wherein the second longitudinal edge of said stop rail is nested against said crank at its angled elbow.

4. The hammer shank stop rail mechanism as recited in claim 1, wherein said crank is configured in an S-shape having both a lower angled elbow proximal to its first end and an upper angled elbow proximal to its second end.

5. The hammer shank stop rail mechanism as recited in claim 1, wherein said stop rail is configured in a transverse cross-section which has contoured surfaces for said longitudinal first and second sides.

6. The hammer shank stop rail mechanism as recited in claim 1, wherein said stop rail comprises a hard felt material having an exterior felt lining.

7. The hammer shank stop rail mechanism as recited in claim 1, wherein said stop rail comprises an extruded aluminum material having a rubber insert at its first longitudinal edge.

8. The hammer shank stop rail mechanism as recited in claim 1, wherein said stop rail comprises an extruded aluminum material having a rubber tube at its first longitudinal edge.

9. The hammer shank stop rail mechanism as recited in claim 1, wherein said control comprises a foot pedal.

10. The hammer shank stop rail mechanism as recited in claim 1, further comprising an electric piano-type keyboard, in addition to said conventional keyboard, which outputs electrical signals during time periods that said piano has its hammer shank stop rail mechanism being actuated by said control.

11. The hammer shank stop rail mechanism as recited in claim 1, further comprising an electric piano-type keyboard, in addition to said conventional keyboard, which outputs electrical signals during time periods that said piano does not have its hammer shank stop rail mechanism being actuated by said control.

12. A fluid-actuated hammer shank stop rail mechanism for use in a piano and actuated by a control of the piano, said piano having a conventional keyboard and a conventional key action for each key, including a plurality of hammer shanks, hammers, and strings, said fluid-actuated hammer shank stop rail mechanism comprising:

(a) a resilient bellows having an expanded, non-actuated condition and a collapsed, actuated condition, said bellows having a first closed end and a second open end comprising a port, fluid being forced from said bellows out through its open port upon actuation by said control thereby placing said bellows into its collapsed, actuated condition, and upon non-actuation by said control, said bellows returns to its expanded non-actuated condition via fluid entering said open port; and (b) an elongated fluid-actuated hammer shank stop rail extending substantially horizontally and terminating in first and second ends, said fluid-actuated stop rail having a fixed rigid portion and an inflatable resilient contact member that expands upon receiving pressurized fluid from the port of said bellows via a fluid passageway that connects said bellows port to said contact member, said contact member extending longitudinally between said first and second ends and having a longitudinal contact surface portion which is constructed of a material to quietly receive an impact from said hammer shanks, said contact member being inflatable and deflatable by said bellows between an extended, actuated position and a retracted, non-actuated position, said contact surface portion being positioned within the path of travel of said hammer shanks thereby preventing said hammers from striking their respective strings when the contact member is in its extended, actuated position, said contact surface portion being positioned outside the path of travel of said hammer shanks thereby allowing said hammers to strike their respective strings when the contact member is in its retracted, non-actuated position.

13. The fluid-actuated hammer shank stop rail mechanism as recited in claim 12, wherein the contact surface portion of said contact member comprises a resilient thin wall of plastic material affixed to and stiffening said contact member.

14. The fluid-actuated hammer shank stop rail mechanism as recited in claim 12, wherein the contact surface portion of said contact member comprises one or more threads of a reinforcing material contained within the wall of the contact member, thereby stiffening said contact member.

15. The fluid-actuated hammer shank stop rail mechanism as recited in claim 12, further comprising a return spring operatively attached to the first end of said bellows configured to assist in re-expanding the bellows.

16. The fluid-actuated hammer shank stop rail mechanism as recited in claim 12, wherein said control comprises a foot pedal.

17. The fluid-actuated hammer shank stop rail mechanism as recited in claim 12, further comprising an electric piano-type keyboard, in addition to said conventional keyboard, which outputs electrical signals during time periods that said piano has its hammer shank stop rail mechanism being actuated by said control.

18. The fluid-actuated hammer shank stop rail mechanism as recited in claim 12, further comprising an electric piano-type keyboard, in addition to said conventional keyboard, which outputs electrical signals during time periods that said piano does not have its hammer shank stop rail mechanism being actuated by said control.

19. A wippen-disabling mechanism for use in a piano and actuated by a control of the piano, said piano having a conventional keyboard and key action per key, including a plurality of wippens, and a plurality of keys having key tails, said wippen-disabling mechanism comprising:

(a) an actuator extending horizontally the width of said keyboard, said actuator overlying the plurality of keys proximal to said key tails and proximal to said plurality of wippens, said actuator having a central portion, a first arm and a second arm, said actuator being rotatable, between a non-actuated position and an actuated position, about an axis that extends longitudinally through said central portion, said first arm underlying said plurality of wippens in a position that is outside the movement paths of both said plurality of key tails and plurality of wippens when the actuator is in its non-actuated position, said first arm abutting and raising said plurality of wippens to a location in which said wippens cannot be operated by said key tails when the actuator is in its actuated position; and (b) a plurality of springs affixed to the second arm of said actuator, each of said springs overlying one of said plurality of key tails, each said spring being spaced-apart from one of said key tails and thereby positioned outside the path of travel of said key tails thereby allowing said key tails to operate their respective wippens when said actuator is in its actuated position, each said spring being urged against a top surface of one of said key tails when said actuator is in its non-actuated position, thereby providing a force against said key tail top surface.

20. The wippen-disabling mechanism as recited in claim 19, wherein the first and second arms of said actuator are oppositely directed.

21. The wippen-disabling mechanism as recited in claim 19, wherein said control comprises a foot pedal.

22. The wippen-disabling mechanism as recited in claim 19, further comprising a spring rate adjustment device and a spring position adjustment device.

23. The wippen-disabling mechanism as recited in claim 19, further comprising a felt pad affixed to the first arm of said actuator which makes contact with said wippens when said actuator is in its actuated position.

24. The wippen-disabling mechanism as recited in claim 19, wherein the force produced against the key tail top surface creates a back-force that a human user will feel when striking the corresponding key, said back-force approximating the key action back-force provided by the corresponding key action when said actuator is in its non-actuated position.

25. The wippen-disabling mechanism as recited in claim 19, wherein said plurality of springs each comprise a torsion spring having a first leg and a second leg, said first leg being affixed to the second arm of said actuator, said second leg being directed toward one of said key tails and causing a torsional load upon said torsion spring as it is urged against the top surface of said key tail when the actuator is in its non-actuated position.

26. The wippen-disabling mechanism as recited in claim 19, further comprising an electric piano-type keyboard, in addition to said conventional keyboard, which outputs electrical signals during time periods that said piano has its hammer shank stop rail mechanism being actuated by said control.

27. The wippen-disabling mechanism as recited in claim 19, further comprising an electric piano-type keyboard, in addition to said conventional keyboard, which outputs electrical signals during time periods that said piano does not have its hammer shank stop rail mechanism being actuated by said control.

28. A hammer shank stop rail mechanism for use in a piano and actuated by a control of the piano, said piano having a conventional keyboard and a conventional key action for each key, including a plurality of hammer shanks, hammers, and strings, said hammer shank stop rail mechanism comprising:

(a) a dowel having a longitudinal body terminating in first and second ends, and extending substantially vertically within said piano, said first end being actuated by said control, wherein said dowel is movable between a first, non-actuated position and a second, actuated position;

(b) an intermediate crank having a first end operatively attached to the second end of said dowel and extending from the second end of said dowel toward a second end of the crank, said crank being movable by said dowel between a first, non-actuated position and a second, actuated position; and (c) an elongated hammer shank stop rail having longitudinal first and second sides and longitudinal first and second edges terminating in first and second ends, one of the sides of said stop rail being operatively attached to said crank at the second end of said crank, said crank being rockable by said dowel to transversely move said stop rail between a first, non-actuated position and a second, actuated position, the first longitudinal edge of said stop rail, when in its actuated position, being positioned within the path of travel of said hammer shanks thereby preventing said hammers from striking their respective strings, the first longitudinal edge of said stop rail, when in its non-actuated position, being positioned outside the path of travel of said hammer shanks thereby allowing said hammers to strike their respective strings, the first longitudinal edge of said stop rail being constructed of a material to quietly receive an impact from said hammer shanks.

29. The hammer shank stop rail mechanism as recited in claim 28, wherein said stop rail is configured in a transverse cross-section which has contoured surfaces for said longitudinal first and second sides.

30. The hammer shank stop rail mechanism as recited in claim 28, wherein said stop rail comprises a hard felt material having an exterior felt lining.

31. The hammer shank stop rail mechanism as recited in claim 28, wherein said stop rail comprises an extruded aluminum material having a rubber insert at its first longitudinal edge.

32. The hammer shank stop rail mechanism as recited in claim 28, wherein said stop rail comprises an extruded aluminum material having a rubber tube at its first longitudinal edge.

33. The hammer shank stop rail mechanism as recited in claim 28, wherein said control comprises a hand-actuator mounted beneath the conventional keyboard, said hand-actuator including a substantially horizontal rod which is longitudinally translatable and having first and second ends, a handle located at the rod's first end, a pivotable link pivotally attached to the rod's second end, a pivotable second crank that is pivotally attached to said pivotable link and movable between a first, non-actuated position and a second, actuated position by said pivotable link, said pivotable second crank being operatively connected to the first end of said dowel such that, when the second crank is moved to its first, non-actuated position, said dowel, intermediate first crank, and stop rail are all moved to their respective first non-actuated positions, and when the second crank is moved to its second, actuated position, said dowel, first intermediate crank, and stop rail are all moved to their respective second, actuated positions.

34. The hammer shank stop rail mechanism as recited in claim 28, further comprising an electric piano-type keyboard, in addition to said conventional keyboard, which outputs electrical signals during time periods that said piano has its hammer shank stop rail mechanism being actuated by said control.

35. The hammer shank stop rail mechanism as recited in claim 28, further comprising an electric piano-type keyboard, in addition to said conventional keyboard, which outputs electrical signals during time periods that said piano does not have its hammer shank stop rail mechanism being actuated by said control.

36. A hammer shank stop rail mechanism for use in a piano and actuated by a control of the piano, said piano having a conventional keyboard and a conventional key action for each key, including a plurality of hammer shanks, hammers, and strings, said hammer shank stop rail mechanism comprising:

(a) a movable cable having first and second ends, said cable's first end being operatively attached to said control of said piano, said cable's second end being operatively attached to a spring, said cable having a first, non-actuated position when said control is non-actuated, said cable having a second, actuated position when said control is actuated;

(b) a rotatable cam having an eccentric lobe portion and a non-eccentric shaft portion, said cam having an axis of rotation extending substantially horizontal and within said piano, said cam having its non-eccentric shaft operatively attached to said cable near the second end of the cable, said cam rotating between a first, non-actuated position, when said cable is in its non-actuated position, and a second, actuated position, when said cable is in its actuated position;

(c) an intermediate bracket having a first end operatively abutting against the eccentric lobe portion of said cam and a second end, said bracket being movable by said cam between a first, non-actuated position and a second, actuated position; and (d) an elongated hammer shank stop rail having longitudinal first and second sides and longitudinal first and second edges terminating in first and second ends, said stop rail being pivotally mounted along a longitudinal axis of rotation, the second end of said bracket being operatively attached to one of the sides of said stop rail, said bracket being movable by said cam to pivot said stop rail between a first, non-actuated position and a second, actuated position, the first longitudinal edge of said stop rail, when in its actuated position, being positioned within the path of travel of said hammer shanks thereby preventing said hammers from striking their respective strings, the first longitudinal edge of said stop rail, when in its non-actuated position, being positioned outside the path of travel of said hammer shanks thereby allowing said hammers to strike their respective strings, the first longitudinal edge of said stop rail being constructed of a material to quietly receive an impact from said hammer shanks.

37. The hammer shank stop rail mechanism as recited in claim 36, wherein the second end of said intermediate bracket is affixed to said stop rail by at least one fastener, and the surface of the first end of said bracket that wears against the eccentric portion of said cam comprises felt.

38. The hammer shank stop rail mechanism as recited in claim 36, wherein said stop rail is configured in a transverse cross-section which has contoured surfaces for said longitudinal first and second sides.

39. The hammer shank stop rail mechanism as recited in claim 36, wherein said stop rail comprises a hard felt material having an exterior felt lining.

40. The hammer shank stop rail mechanism as recited in claim 36, wherein said stop rail comprises an extruded aluminum material having a rubber insert at its first longitudinal edge.

41. The hammer shank stop rail mechanism as recited in claim 36, wherein said stop rail comprises an extruded aluminum material having a rubber tube at its first longitudinal edge.

42. The hammer shank stop rail mechanism as recited in claim 36, wherein said control comprises a foot pedal.

43. The hammer shank stop rail mechanism as recited in claim 36, further comprising an electric piano-type keyboard, in addition to said conventional keyboard, which outputs electrical signals during time periods that said piano has its hammer shank stop rail mechanism being actuated by said control.

44. The hammer shank stop rail mechanism as recited in claim 36, further comprising an electric piano-type keyboard, in addition to said conventional keyboard, which outputs electrical signals during time periods that said piano does not have its hammer shank stop rail mechanism being actuated by said control.

* * * * *